US009624766B2

(12) United States Patent
Draper et al.

(10) Patent No.: US 9,624,766 B2
(45) Date of Patent: Apr. 18, 2017

(54) METHOD AND SYSTEM TO QUANTIFY DAMAGE TO GRAVEL PACK SCREENS

(71) Applicants: Ian Draper, Godalming (GB); Bruce Girrell, Traverse City, MI (US)

(72) Inventors: Ian Draper, Godalming (GB); Bruce Girrell, Traverse City, MI (US)

(73) Assignee: BAKER HUGHES INCORPORATED, Houston, TX (US)

( * ) Notice: Subject to any disclaimer, the term of this patent is extended or adjusted under 35 U.S.C. 154(b) by 380 days.

(21) Appl. No.: 14/299,119

(22) Filed: Jun. 9, 2014

(65) Prior Publication Data

US 2015/0354344 A1 Dec. 10, 2015

(51) Int. Cl.
*E21B 47/10* (2012.01)
*E21B 43/04* (2006.01)

(52) U.S. Cl.
CPC ..... *E21B 47/102* (2013.01); *E21B 43/04* (2013.01)

(58) Field of Classification Search
CPC ..... E21B 47/10; E21B 47/102; E21B 43/04; E21B 43/08; E21B 47/09
See application file for complete search history.

(56) References Cited

U.S. PATENT DOCUMENTS 3,940,689 A 2/1976 Johnson, Jr.
4,675,604 A 6/1987 Moyer et al.
4,769,598 A 9/1988 Krieg et al.
2004/0100256 A1 5/2004 Fickert et al.
2011/0054808 A1* 3/2011 Pearce ..... E21B 47/0006 702/42

FOREIGN PATENT DOCUMENTS

EP 2378058 A2 10/2011

OTHER PUBLICATIONS

Hyde-Barber et al., "Ultrasound Logging Techniques for the Inspection of Sand Control Screen Integrity", SPE/ICoTA Coiled Tubing and Well Intervention Conference and Exhibition, Apr. 5-6, 2011, pp. 1-18.
International Search Report and Written Opinion for PCT Application No. PCT/US2015/033505, dated Aug. 21, 2015, pp. 1-13.

* cited by examiner

*Primary Examiner* — Yong-Suk (Philip) Ro
(74) *Attorney, Agent, or Firm* — Cantor Colburn LLP

(57) ABSTRACT

A system and method to quantify damage to a gravel pack screen include the use of a flux leakage tool to record electromagnetic field measurements at a plurality of points on the gravel pack screen. The system also includes a processor to obtain the electromagnetic field measurements recorded at the plurality of points and to suppress a baseline signal associated with electromagnetic field measurements resulting from perforations of the gravel pack screen to isolate and quantify flux leakage resulting from the damage to the gravel pack screen from flux leakage resulting from the perforations.

15 Claims, 4 Drawing Sheets

METHOD AND SYSTEM TO QUANTIFY DAMAGE TO GRAVEL PACK SCREENS

BACKGROUND

In downhole exploration and production efforts, steel structures such as pipes and casing are often used. This downhole equipment is susceptible to corrosion and pitting due to environmental effects and use. Thus, inspection of this downhole equipment to detect and mitigate issues such as corrosion and other forms of metal loss, for example, is essential to maintaining the integrity and functionality of the downhole equipment.

SUMMARY

According to an embodiment of the invention, a system to quantify damage to a gravel pack screen includes a flux leakage tool configured to record electromagnetic field measurements at a plurality of points on the gravel pack screen; and a processor configured to obtain the electromagnetic field measurements recorded at the plurality of points and to suppress a baseline signal associated with electromagnetic field measurements resulting from perforations of the gravel pack screen to isolate and quantify flux leakage resulting from the damage to the gravel pack screen from flux leakage resulting from the perforations.

According to another embodiment of the invention, a method of quantifying damage to a gravel pack screen includes obtaining, using a flex leakage tool, electromagnetic field measurements at a plurality of points on the gravel pack screen; removing, using a processor, a baseline signal associated with electromagnetic field measurements resulting from perforations of the gravel pack screen from the electromagnetic field measurements at the plurality of points; and isolating and quantifying flux leakage resulting from the damage to the gravel pack screen from flux leakage resulting from the perforations based on the removal.

BRIEF DESCRIPTION OF THE DRAWINGS

Referring now to the drawings wherein like elements are numbered alike in the several Figures.

DETAILED DESCRIPTION

As noted above, the integrity downhole equipment, such as pipes, must be monitored and maintained. One way that piping has been monitored is by a magnetic flux leakage (MFL) tool. An MFL tool basically operates by using a permanent magnet to temporarily magnetize the pipe and recording and analyzing the resulting magnetic field changes. When there are no flaws in the wall of the pipe, the magnetic flux is uniform. When internal or external flaws are present (e.g., pitting, corrosion, other damage), the magnetic flux is distorted beyond the wall of the pipe and this distortion or "flux leakage" may be measured (e.g. by Hall Effect sensors). While the use of an MFL tool to inspect a regular (solid-wall) pipe is fairly straight-forward, the inspection of a gravel pack screen presents challenges.

A gravel pack screen is a filter used for sand control downhole. A gravel pack screen prevents sand from moving up within the well with hydrocarbons, for example. In a cased or uncased borehole, a pipe section is manufactured as a perforated screen with gravel-based slurry packed on the outside of the screen. The section of the gravel pack acts as a filter preventing sand from moving above it while allowing the product of interest (e.g., hydrocarbons) to pass through. Parameters such as the size of the perforations in the screen, the size and other characteristics of the gravel, for example, must be designed specifically for the type of sand expected in the downhole environment. Because the screen (unlike a solid-wall pipe section) already has perforations, the use of a MFL tool is not the same in a gravel pack screen section as in a solid-wall pipe section. This is because the (necessary and desired) perforations in the screen result in distortion or "flux leakage" that resemble (undesirable) corrosion or pitting in a solid-walled pipe section.

Embodiments of the system and method detailed herein relate to processing of MFL tool data that facilitates the use of an MFL tool in a gravel pack screen. The embodiments of the system and method prevent false-positive results that may represent a perforation in the screen as corrosion.

Figure 1:
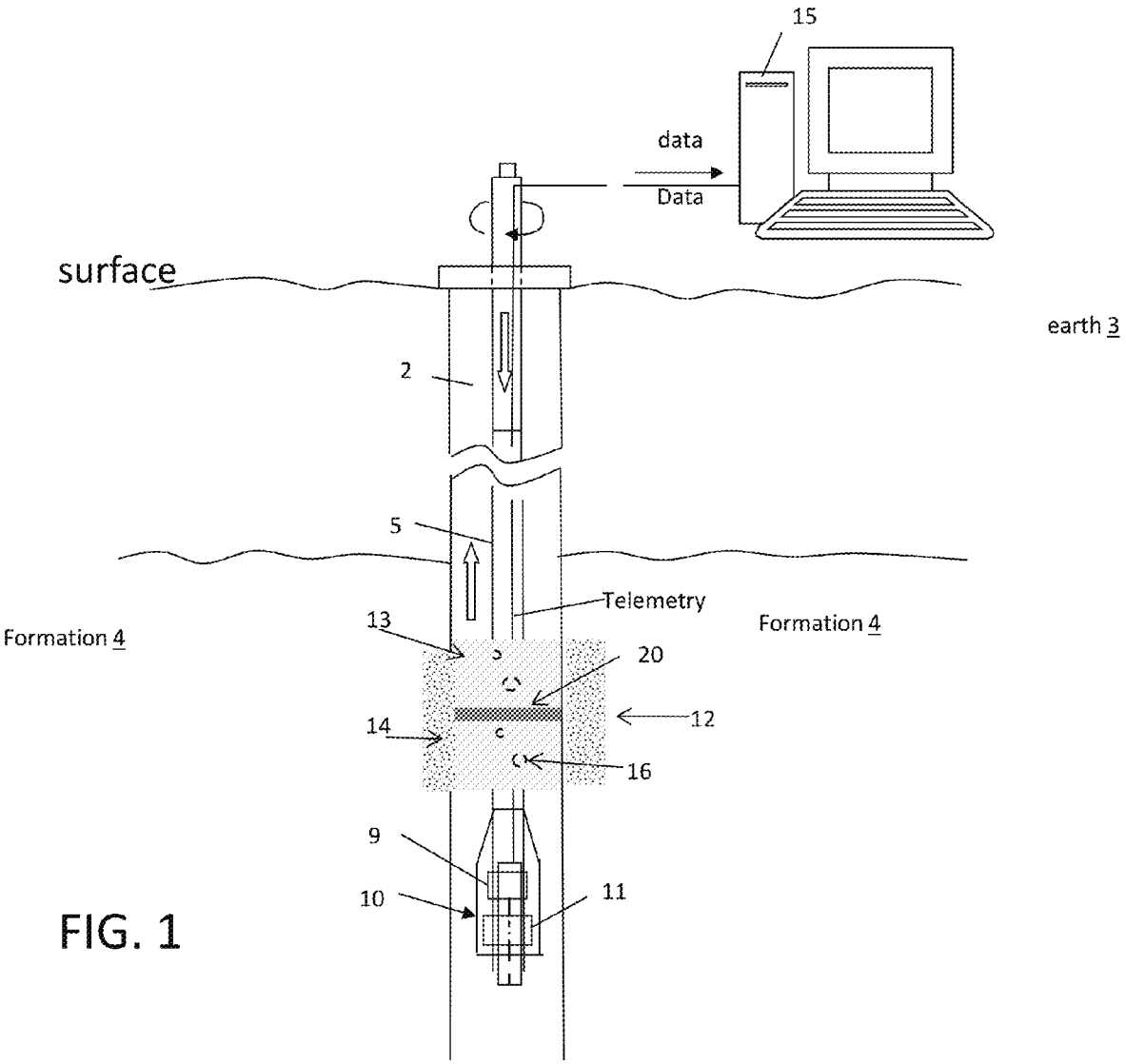
FIG. 1 is a cross-sectional view of a downhole system including a gravel pack screen and flux leakage tool according to embodiments of the invention.

FIG. 1 is a cross-sectional view of a downhole system including a gravel pack screen filter 12 and flux leakage tool 20 according to embodiments of the invention. While the system may operate in any subsurface environment, FIG. 1 shows a gravel pack screen filter 12 disposed in a borehole 2 penetrating the earth 3. A pipe 5 extends downhole with a portion of the pipe 5 including the gravel pack screen filter 12 comprised of the perforated screen 13 (perforations 16) and a gravel slurry 14 packed around the screen 13. As noted above, the gravel pack screen filter 12 acts as a filter for sand that may be disturbed by the drilling, for example. Based on the size of the gravel and other factors specific to the formation 4, the gravel pack screen filter 12 prevents the sand from continuing up the borehole 2 while allowing hydrocarbons or other production materials to pass. The downhole system also includes a downhole tool 10 that may include measurement tools 11 and downhole electronics 9 configured to perform one or more types of measurements in an embodiment referred to as wireline logging. Raw data and/or information processed by the downhole electronics 9 may be telemetered to the surface for additional processing or display by a computing system 15. Control signals may be generated by the computing system 15 and conveyed downhole or may be generated within the downhole electronics 9 or by a combination of the two according to embodiments of the invention. The downhole electronics 9 and the computing system 15 may each include one or more processors and one or more memory devices. In alternate embodiments, the downhole tool 10 may perform one or more types of measurements during drilling in a process referred to as Logging-While-Drilling (LWD) or Measurement-While-Drilling (MWD). Inspection of the gravel pack screen filter 12 using a flux leakage tool 20 and one or more processors (9, 15) is further discussed below.

Figure 2:
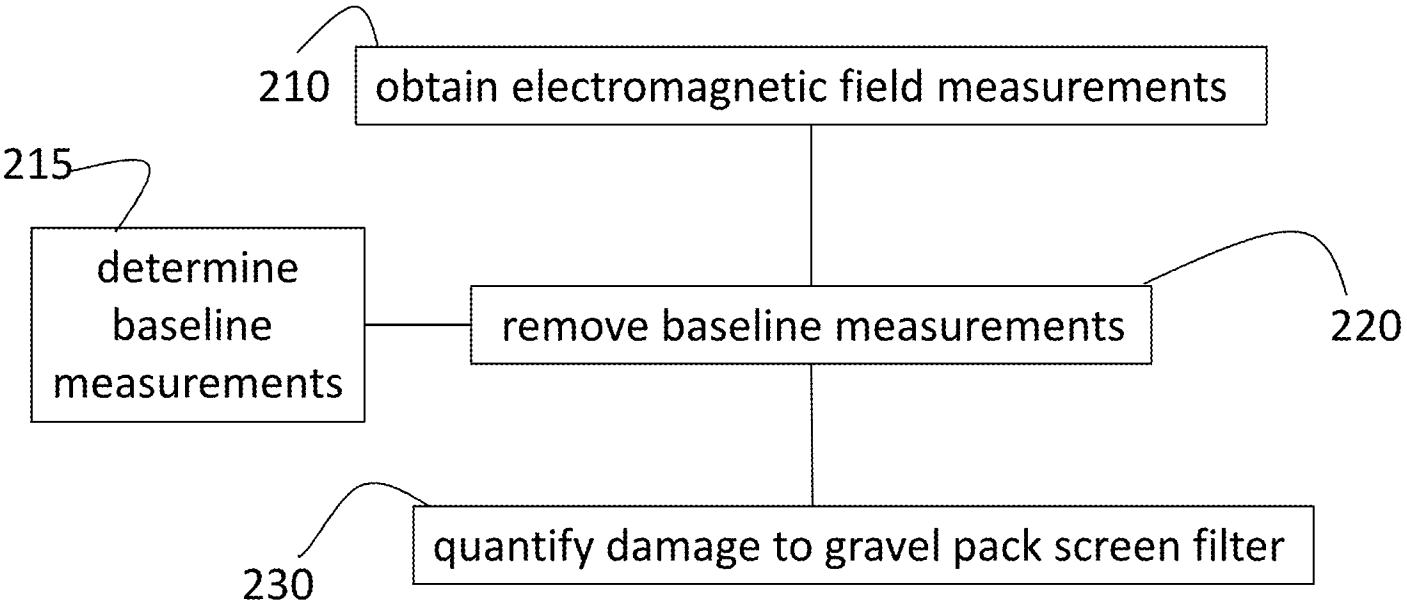
FIG. 2 is a process flow of a method of inspecting a gravel pack screen filter according to an embodiment of the invention.

FIG. 2 is a process flow of a method of inspecting a gravel pack screen filter 12 according to an embodiment of the invention. At block 210, obtaining electromagnetic field measurements includes using a flux leakage tool 20. An exemplary flux leakage tool 20 is discussed below, but embodiments of the system and method are not limited to the use of any particular flux leakage tool 20. The electromagnetic field measurements obtained with any flux leakage tool 20 will indicate disturbances (flux leakage) associated with both the (necessary) perforations 16 in the screen 13 and (undesirable) defects in the screen 13 of the gravel pack screen filter 12. The flux leakage tool 20 may be comprised of a number of sensors deployed circumferentially (as shown in the exemplary embodiment of FIG. 1). The sensors of the flux leakage tool 20 obtain electromagnetic field measurements around the circumference of the screen 13 and may move axially to obtain the (circumferential) measurements at various points along the axis length of the screen 13. The downhole electronics 9, the surface computing system 15, or a combination of the two may receive and process the electromagnetic field measurements from the flux leakage tool 20. At block 215, determining baseline measurements includes obtaining, as closely as possible, electromagnetic field measurements expected for the (undamaged) gravel pack screen filter 12 (including the perforations 16). The baseline measurements may be determined through laboratory measurements using the actual gravel pack screen filter 12 either offline after manufacture or downhole prior to use, for example. The baseline measurements may also be determined through modeling, or through a combination of laboratory testing and modeling. The position of the perforations 16 would be used in the modelling, for example. According to one embodiment, the baseline may be obtained by recording electromagnetic measurements for intervals of undamaged screen to generate an average or generic baseline. This could be done on the surface in a test environment or downhole in the borehole 2. Examples of baseline measurements from undamaged screens could be retained and used as a database. According to another embodiment, the baseline may be obtained by calculating the expected response using modelling software. The processing includes removing or suppressing the baseline measurements from the magnetic field measurements at block 220. The removing isolates the measurements related to defects in the screen 13 by eliminating measurements related to the perforations 16. Thus, once the measurements resulting from the perforations 16 are removed, quantifying the damage to the gravel pack screen filter 12 at block 230 is facilitated. Specifically, disturbances (flux leakage) are identified based on the measurements of electromagnetic field to identify areas with potential damage and the amount of damage.

Figure 3:
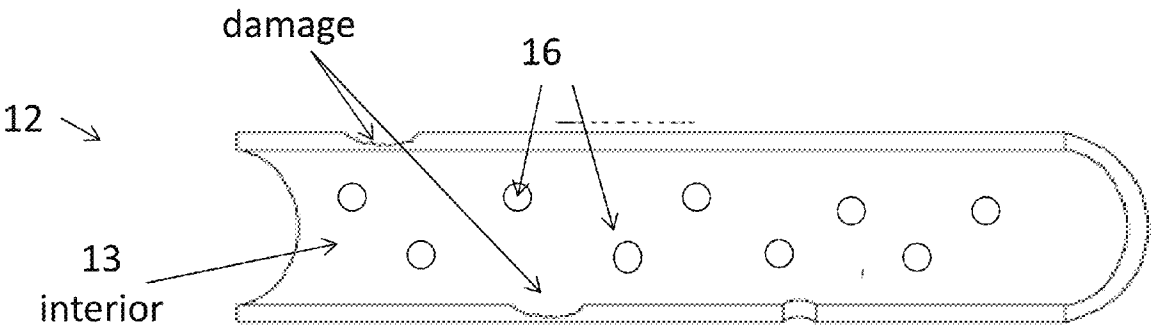
FIG. 3 illustrates a cross-sectional view of a gravel pack screen filter.
Figure 4:
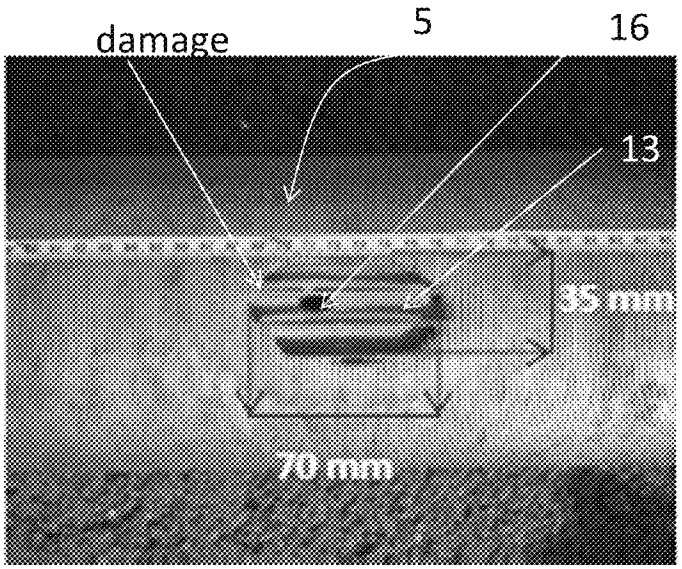
FIGS. 4-5 illustrate damage to an exemplary gravel pack screen filter.
Figure 5:
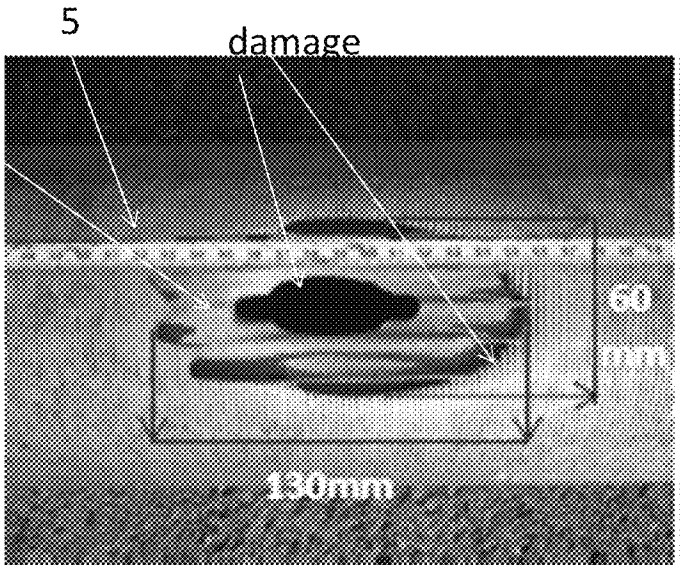
Figure 6:
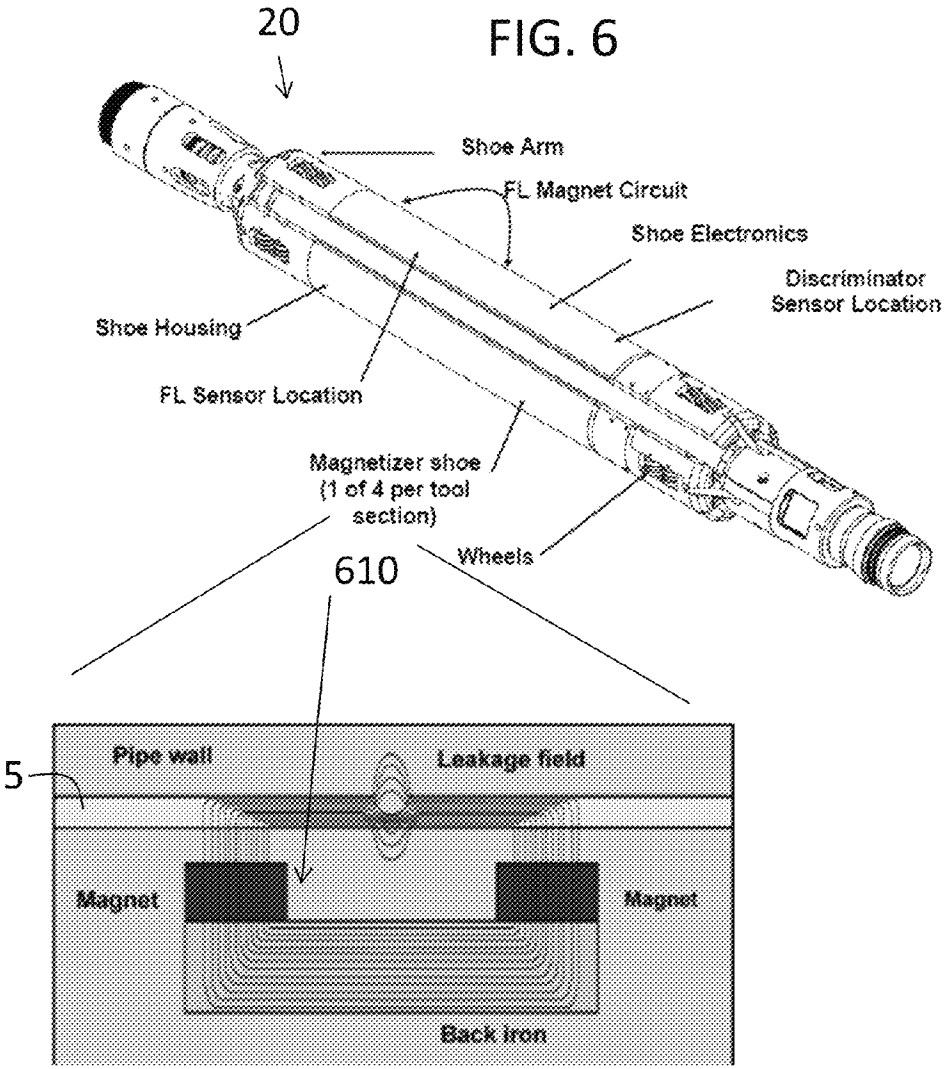
FIG. 6 illustrates an exemplary flux leakage tool.
Figure 7:
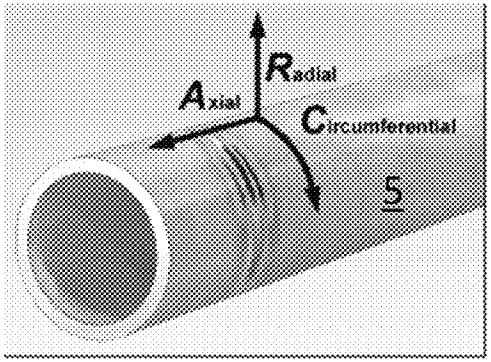
FIG. 7 illustrates the axes in which the flux leakage tool measures the electromagnetic field.

FIG. 3 illustrates a cross-sectional view of a gravel pack screen filter 12. As FIG. 3 indicates, corrosion or other damage may start in the interior (as shown at the bottom of the screen 13) and expand out or may start in the exterior (as shown at the top of the screen 13) and work its way in. FIGS. 4-5 illustrate damage to an exemplary gravel pack screen filter 12. In FIG. 4, the damage (corrosion) to the pipe 5 is not so severe that it affects the perforation 16. In FIG. 5, the corrosion in the pipe 5 has reached the screen 13 and increased the size of the perforation 16 to the extent that the perforation 16 is part of the damaged area. FIG. 6 illustrates an exemplary flux leakage tool 20. The horse-shoe shaped magnetizer 610 is shown in further detail relative to a pipe 5 wall. The electromagnetic field (leakage field) resulting from damage to the pipe 5 wall is also shown. FIG. 7 illustrates the axes in which the flux leakage tool 20 measures the electromagnetic field. That is, the flux leakage recorded by the flux leakage tool 20 is a vector value with axial, radial, and circumferential components.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A system to quantify damage to a gravel pack screen, the system comprising:

a flux leakage tool configured to record electromagnetic field measurements at a plurality of points on the gravel pack screen; and a processor configured to obtain the electromagnetic field measurements recorded at the plurality of points and to remove a baseline signal associated with electromagnetic field measurements resulting from perforations of the gravel pack screen to isolate and quantify flux leakage resulting from the damage to the gravel pack screen from flux leakage resulting from the perforations.

2. The system according to claim 1, wherein the processor associates the flux leakage resulting from the damage to an amount of the damage.

3. The system according to claim 1, wherein the flux leakage is obtained as a vector quantity with axial, radial, and circumferential components.

4. The system according to claim 1, wherein the flux leakage tool comprises a plurality of sensors to obtain the electromagnetic field measurements at the plurality of points, each of the plurality of sensors configured to record the electromagnetic field measurements at a different circumferential location of the gravel pack screen as the flux leakage tool moves along an axial length of the gravel pack screen.

5. The system according to claim 1, wherein the processor is disposed at a surface location.

6. The system according to claim 1, wherein the processor determines the baseline signal based on laboratory testing.

7. The system according to claim 1, wherein the processor determines the baseline signal based on modelling.

8. The system according to claim 1, wherein the processor determines the baseline signal based on a combination of laboratory testing and modelling.

9. A method of quantifying damage to a gravel pack screen, the method comprising:

obtaining, using a flex leakage tool, electromagnetic field measurements at a plurality of points on the gravel pack screen;

removing, using a processor, a baseline signal associated with electromagnetic field measurements resulting from perforations of the gravel pack screen from the electromagnetic field measurements at the plurality of points; and isolating and quantifying flux leakage resulting from the damage to the gravel pack screen from flux leakage resulting from the perforations based on the removal.

10. The method according to claim 9, further comprising identifying an amount of the damage to the gravel pack screen based on the isolating the flux leakage resulting from the damage.

11. The method according to claim 9, wherein the isolating the flux leakage includes obtaining a vector quantity with axial, radial, and circumferential components.

12. The method according to claim 9, wherein the obtaining the electromagnetic field measurements includes each of a plurality of sensors of the flux leakage tool recording the electromagnetic field measurements at a different circumferential location of the gravel pack screen as the flux leakage tool moves along an axial length of the gravel pack screen.

13. The method according to claim 9, further comprising determining the baseline signal based on laboratory testing.

14. The method according to claim 9, further comprising determining the baseline signal based on modelling.

15. The method according to claim 9, further comprising determining the baseline signal based on a combination of laboratory testing and modelling.

* * * * *